United States Patent [19]

Olson

[11] Patent Number: 5,052,701

[45] Date of Patent: Oct. 1, 1991

[54] ROLLER SKATE WITH PIVOTING BRAKE

[75] Inventor: Brennan J. Olson, Minneapolis, Minn.

[73] Assignee: Rollerblade, Inc., Minnetonka, Minn.

[21] Appl. No.: 397,184

[22] Filed: Aug. 23, 1989

[51] Int. Cl.[5] ..... A63C 17/14

[52] U.S. Cl. ..... 280/11.2; 188/1.11; 188/5; 280/11.27

[58] Field of Search ..... 280/11.2, 11.19, 11.27; 188/1.11, 5

[56] References Cited

U.S. PATENT DOCUMENTS

| | | | |
|---|---|---|---|
| Re. 32,346 | 2/1987 | Klamer et al. | 280/11.2 |
| 805,942 | 11/1905 | Beals | 280/11.2 |
| 864,333 | 8/1907 | Pilz | 280/11.2 |
| 2,191,018 | 2/1940 | Ickenroth | 280/11.2 |
| 2,220,557 | 11/1940 | User | 280/11.22 |
| 2,343,007 | 2/1944 | Goldenberg | 280/11.2 |
| 2,644,692 | 7/1953 | Kahlert | 280/11.22 |
| 2,826,422 | 3/1958 | Snyder | 280/11.2 |
| 2,872,201 | 2/1959 | Wagers | 280/11.2 |
| 2,941,812 | 6/1960 | Reynolds | 280/11.2 |
| 3,003,776 | 10/1961 | Ware | 280/11.2 |
| 3,112,119 | 11/1963 | Sweet | 280/11.2 |
| 3,112,120 | 11/1963 | Ware | 280/11.2 |
| 3,287,023 | 11/1966 | Ware | 280/11.2 |
| 4,088,335 | 5/1978 | Norton et al. | 280/11.18 |
| 4,108,450 | 8/1978 | Cote | 280/7.13 |
| 4,273,345 | 6/1981 | Ben-Dor | 280/11.22 |
| 4,298,209 | 11/1981 | Peters | 280/11.2 |
| 4,351,537 | 9/1982 | Seidel | 280/11.12 |
| 4,392,659 | 7/1983 | Yoshimoto | 280/11.23 |
| 4,417,737 | 11/1983 | Suroff | 280/11.115 |
| 4,418,929 | 12/1983 | Gray | 280/11.23 |
| 4,492,385 | 1/1985 | Olson | 280/11.22 |
| 4,711,458 | 12/1987 | Shim | 280/11.22 |
| 4,909,523 | 3/1990 | Olson | 280/11.2 |

FOREIGN PATENT DOCUMENTS

| | | | |
|---|---|---|---|
| 1341539 | 9/1963 | France . | |
| 1402028 | 8/1975 | France . | |
| 88532 | 2/1976 | France | 280/11.2 |

OTHER PUBLICATIONS

North American Sports Training Corporation 1986-87 Catalog, copyright 1986.

Rollerblade "get in-line" 1987-88 Catalog, copyright 1987.

Rollerblade 1988-89 Catalog, copyright 1988.

Rollerblade Spring '89 Catalog, copyright 1989.

Rollerblade Pink Shirt Catalog, copyright 1989.

Rollerblade Seashore Catalog, copyright 1989.

Rollerblade "Bladegear" 1989-90 Catalog, copyright 1989.

Rollerblade "Skates+" 1989-90 Catalog, copyright 1989.

Rollerblade "Perfect Gift for Anybody" Fold-Out Brochure, distributed . . . 8/8/89.

*Primary Examiner*—Andres Kashnikow

*Assistant Examiner*—Eric Culbreth

*Attorney, Agent, or Firm*—Moore & Hansen

[57] ABSTRACT

A roller skate and brake utilizes a generally flat rectangular road surface engaging base which pivots about the rear wheel through an arc of approximately twelve degrees to achieve full facial engagement with the road surface to achieve safer, more controlled braking. The brake pad is provided with an internal plate which provides an audible and vibrating wear indicator to alert the skater to replace the brake pad. The pad has an upright, arcuate protuberance and a transverse rib which are mateably received within an arcuate cross section socket and a slot adjacent the socket to closely restrain and confine the brake pad within a brake pad housing when the brake pad is attached to the housing.

18 Claims, 1 Drawing Sheet

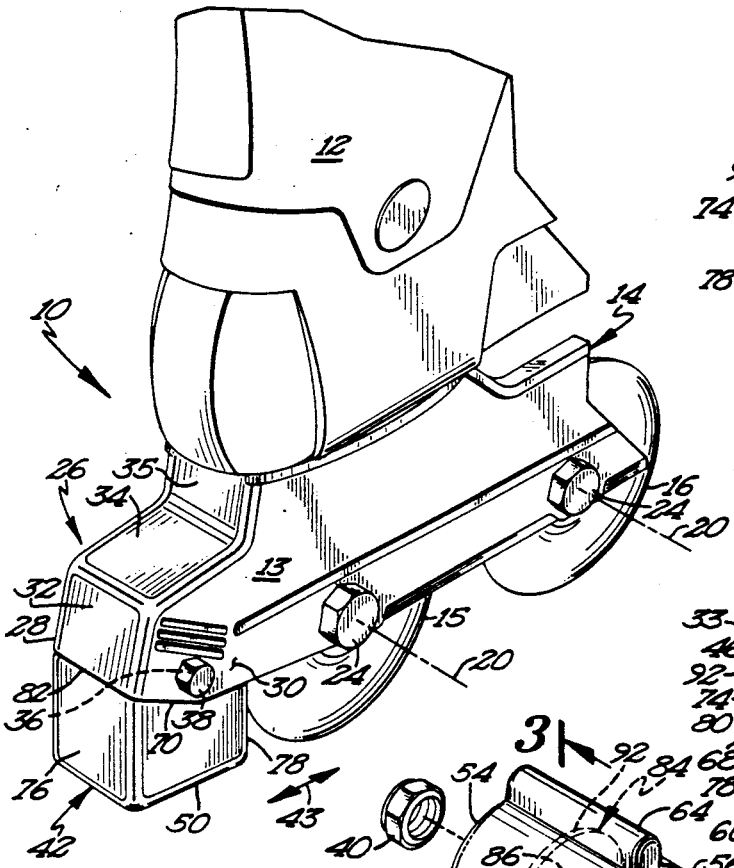
Fig. 1
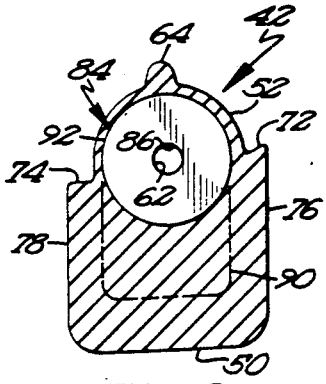
Fig. 3
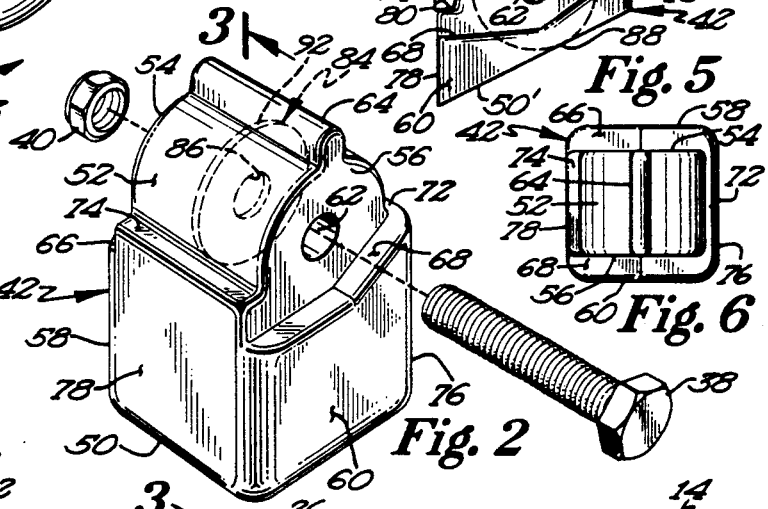
Fig. 2
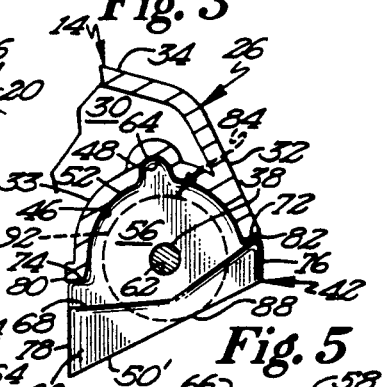
Fig. 5
Fig. 6
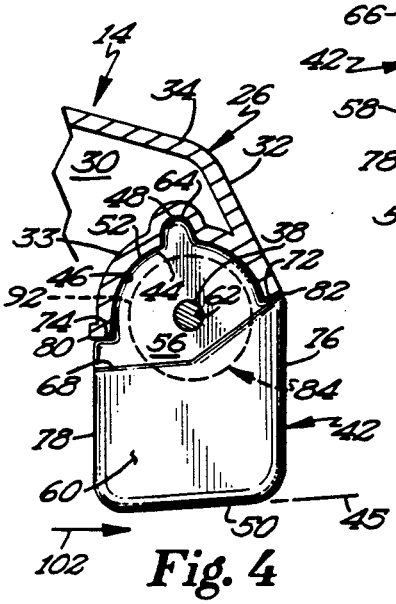
Fig. 4
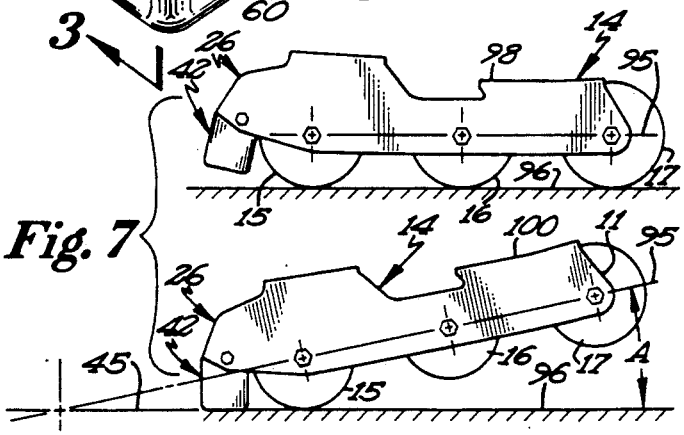
Fig. 7

ROLLER SKATE WITH PIVOTING BRAKE

BACKGROUND OF THE INVENTION

The invention relates to roller skates and brakes usable with such skates and provides a safer, more effective, easier to use brake suitable for both experienced and inexperienced skaters.

Roller skate frames generally have a brake at either the front or rear thereof, with the rear position being the more frequently used position because a brake at the front of the skate requires the skater to lean forward to engage the brake and can adversely affect the skater's balance and even cause the skater to fall.

Rear positioned roller skate brakes are actuated by the skater pivoting rearwardly about the axis of the rear skate wheel and swinging the skate from the normal coasting position to a braking position where the brake drags against the road surface and brings the skater to a stop. Brakes such as these are shown in the following patents:

| | | |
|---|---|---|
| 3,287,023 | G. K. Ware | November 22, 1966 |
| 2,826,422 | C. W. Snyder | March 11, 1958 |
| 2,343,007 | M. Goldenberg | February 29, 1944 |
| 805,942 | G. M. Beals | November 28, 1905 |
| 4,392,659 | K. Yoshimoto | July 12, 1983 |
| 4,273,345 | Ben Dor et al | June 16, 1981 |

While many different brakes have been used at the rearmost end of roller skates, most such brakes have a pad which is generally circular in cross section. When the road engaging end of such brakes is urged against the road, only a small portion of the braking surface actually contacts the road surface until the brake has become notably worn. This results in poorer braking results until the brake pad has been broken in. A structure of this type and which is part of the prior art is shown in U.S. Pat. No. 4,909,523 issued Mar. 20, 1990 wherein the brake pad has a circular cross section pad with a base having a curved surface and positioned rearwardly of the skate frame wherein the brakes must be pivoted through approximately fifteen degrees to be brought into contact with the road surface. Only after a break-in period will more than a fractional part of that brake pad's road snagging surface contact the road, and to do so the skate will have to be pivoted through an angle of between seventeen and twenty degrees.

An effective brake assembly positioned rearward of the skate must not extend sideward beyond the width of the skate frame, or the brake may snag on roadside obstacles and affect the skater's balance or cause him to fall. An effective rear mounted brake must also be configured to avoid snagging when the skater encounters an incline such as a driveway apron or when he crosses irregular height cracks on sidewalks or roads. Prior art brakes have avoided the problem of dragging when incline or cracks are encountered by spacing the brake pad sufficiently upward from the road surface to avoid unwanted contact Typically, a skater must pivot such a brake through an arc of at least fifteen degrees and often even more to bring the brake pad into frictional contact with the road surface.

While such high positioning of the brake does avoid snagging of the brake, the arc which is required to be spanned before braking can occur forces the skater to move his foot through such a large arc that he must jeopardize his balance in order to apply the brake. An inexperienced skater finds it very intimidating to pivot his foot rearwardly through fifteen or more degrees in order to get the brake working, and this large arc has made many new skaters reluctant to use roller skates. Whith these problems in mind there is a real need for an improved brake mechanism which can be actuated with less pivoting by both experienced and inexperienced skaters.

Prior art brake systems have positioned their brake pads so that only a fractional part of the road engaging braking surface contacts the road surface when the brake is first employed. As the brake wears away during break-in use, the surface area which engages the road surface gradually increases. However, in order to apply that increasing braking surface to the road, a still greater arc of swing must be completed by the skater to bring the more worn brake pad to the road surface. It is desirable that the brake be configured to provide a maximum level of friction surface immediately on deployment without requiring a break-in period.

Still a further difficulty with known brakes is that as the brake pad wears down, and the brake becomes less effective, many skaters do not initially realize the serious wear that has occurred and they replace the brake only when the unit has failed so severely as to be inoperative or after the skate frame has been damaged. It is desirable to provide a mechanism to alert the skater to the need of replacing the brake pad before the pad is dangerously unusable.

In providing a solution to these problems, a working brake housing and pad must also be lightweight, strong, durable and aesthetically pleasing to the eye. The invention described hereafter provides a solution for these needs and provides a much improved brake system.

SUMMARY OF THE INVENTION

A roller skate and brake is provided with a new brake housing and brake pad which may be deployed against a road surface by pivoting the skate about its rear wheel through an arc of approximately twelve degrees. This significantly reduced arc offers improved braking results while permitting the skater to better retain his balance and to apply the brake without the extensive rearward pivoting required by prior art brake systems.

The brake pad also offers a significantly larger, flat, rectangular road engaging surface which achieves full facial contact with the road surface throughout the use life of the brake, avoiding the need for a break-in period. The rectangular cross section contact area of the brake's base may be positioned directly behind the skate frame without increasing the brake width so much that the brake extends beyond the side profile of the skate frame. The structure thus permits use of the larger brake pad without any higher risk of snagging the brake on obstructions on either side of the skater's path.

A metal plate is positioned inside the brake pad body to serve as a wear indicator. As the plate becomes exposed to the road surface as a result of brake pad wear, continued use of the brake causes the brake pad to vibrate in a distinct manner which is immediately noticeable to the skater and alerts the skater to the need for brake replacement. The dragging of the metal plate on the road surface during braking also generates a distinctive sound which further alerts the skater.

The adoption of a brake pad with a larger, more effective road engaging surface has been found to require a brake housing and pad with a stronger retention and mounting arrangement in order to counter the stronger reaction forces applied to the brake housing during braking. The brake pad has an upwardly extending arcuate protuberance which is received within the socket of the brake housing, and a screw and nut passes through a horizontal passage which extends through the housing, brake pad, and metal plate. The upper section of the brake pad is structured to interact with the side walls, front wall, and rear wall of the brake housing to stabilize the pad and to prevent torquing and twisting of the pad which might dislodge it from the housing.

These and other objects and advantages of the invention will appear more fully from the following description made in conjunction with the accompanying drawings wherein like reference characters refer to the same or similar parts throughout the several views.

BRIEF DESCRIPTION OF THE DRAWINGS

FIG. 1 is a side perspective view of a rollerskate and brake embodying the invention.

FIG. 2 is a side perspective view of the brake pad of FIG. 1.

FIG. 3 is a cross sectional side view of the brake pad of FIG. 2 taken in the direction of cutting plane 3—3 of FIG. 2.

FIG. 4 is a cross sectional side view of the brake pad installed in the brake pad housing.

FIG. 5 is a cross sectional side view like that of FIG. 4 but showing a worn brake pad in which the wear indicator has become exposed.

FIG. 6 is a top view of the brake pad.

FIG. 7 is a side elevation view of a roller skate and brake embodying the invention and showing the brake in each of two operating positions.

DESCRIPTION OF THE PREFERRED EMBODIMENT

Referring now to the drawing, an in-line roller skate and brake 10 includes a boot 12 for wear by a skater, and a strong, lightweight, molded roller skate frame 14 formed of synthetic material and carried by the boot 12.

A plurality of wheels, here shown in FIG. 7 as wheels 15, 16, and 17 are rotatably mounted to the frame 14 for rotation about a plurality of axles having parallel axes 20, each of the wheels being mounted to the frame by bolt and nut combinations 24, or the like which serve as axles. The frame 14 will normally carry three to five wheels, and frames having up to five or more wheels are within the purview of the invention. As shown in FIGS. 1 and 7, each of the wheels has its central axis in a common plane 95 which is substantially parallel to the road surface 96, and all the wheels engage the road surface during coasting and are coasting wheels. Some four wheeled skates are structured to have their intermediate wheels positioned lower than the front and rear wheels, and utilize only the intermediate wheels as coasting wheels. Skates with wheels at different levels may be used with the brake described herein and are within the purview of the invention.

A brake pad housing 26 is located at the rear end 13 of frame 14 and is provided with first and second lateral sidewalls 28 and 30, a rear wall 32, a front wall 33, and a cap 34 which joins the transverse surface 35 of the frame. A screw aperture 36 passes through lateral sidewalls 28 and 30 and is oriented parallel to the axes 20 of wheels 15, 16, and 17 and receives a screw 38 which threads into nut 40 so as to securely retain brake pad 42 within a rigid socket 44 located between the sidewalls 28 and 30. The socket 44, when viewed from the side, as best shown in FIG. 4, has an arcuate cross section 46 with a substantially constant radius. A slot 48 is located within the socket 44 and extends transversely across the top thereof.

Although the brake housing has been shown as being an integral part of the frame 14, it should be understood that the housing could be a separate housing unit mounted either at the rear of the skate frame 14, or alternatively used with other roller skates, and such alternatives are within the purview of the invention.

The brake pad 42 is an integrally molded body of rubber or other like material possessing a high coefficient of friction to achieve efficient braking action when the pad is urged against the road surface 96. The term "road surface" as used herein is not limited to actual road surfaces and encompasses any usable surface on which roller skating can be done, including without limitation, roads, sidewalks, decks or the like, including indoor and outdoor surfaces. It has been found that molded rubber having a durometer hardness of between 85 and 95 provides excellent results when used as the material for the brake pad body.

As best shown in FIG. 6, the brake pad 42 has a generally rectangular cross section as viewed from above, and the cross section may be square or elongated in the forward or rearward travel directions 43 of the skate. It is desirable that the width of the brake pad as measured between faces 58 and 60 not exceed the width of the frame 14 so as to avoid snagging of the brake pad against obstacles that might be encountered along the skater's path. The pad 42 has a base 50 which has a substantially flat surface which defines a plane 45 and which is angled relative to front face 70 so base 50 can be held against the road surface 96 with the flat base surface being in full facial engagement with the road surface. Such result is best achieved when the plane 45 intersects the plane 95 of the wheel axes at an angle A which is between eleven and thirteen degrees , with twelve degrees producing the best result. It has been found highly desirable to utilize an angle between eleven and thirteen degrees in order to significantly improve the braking operation and make braking safer for skaters. While prior art roller skates utilizing rear mounted brakes require their operators to pivot the skate rearwardly through fifteen or more degrees of arc in order to engage even a fractional part of the brake pad base, applicant has found that this large arc adversely affects the balance of the skater, and can be particularly intimidating to an inexperienced skater. It is highly desirable to limit the arc of rearward pivoting to no more than thirteen degrees, with twelve degrees being highly effective. This angle range results in more comfortable braking and allows even inexperienced skaters to better maintain balance. To achieve this angled relationship, the plane 45 of base 50 is positioned at an angle between eleven and thirteen degrees relative to the plane 95. Accordingly, the skater can tilt the skate frame 14 back through the angle A, not exceeding thirteen degrees, and bring the base 50 into substantially full facial engagement with the road surface 96.

Referring now to FIG. 2, an arcuate protrusion 52 having a generally uniform radius extends transversely across the upper portion of brake pad 42 and has flat ends 54 and 56 spaced inwardly from first and second generally parallel side faces 58 and 60, respectively. A straight, horizontal bore 62 is formed within the arcuate protrusion 52, extends between ends 54 and 56 and is substantially concentric with the protrusion 52. The bore 62 is positioned to align coaxially with the apertures 36 through the side walls 28 and 30 of the brake housing and the apertures 36 and bore 62 form a continuous passage 62. An upwardly extending and transversely oriented rib 64 is formed at the top of the protrusion 52 and is mateably received within the slot 48 of socket 44 when the pad 42 is attached to the brake housing 26.

First and second lateral ledges 66 and 68 are positioned below the ends 54 and 56, respectively, of the protrusion 52 and recessed inwardly a predetermined distance from side faces 58 and 60, respectively, to provide seats for side walls 28 and 30, each side wall having its lower edge 70 closely engaging a lateral ledge. The side walls 28 and 30 also sandwich the ends 54 and 56 and when the screw 38 and nut 40 are installed, the side walls closely confine the ends of the protrusion and restrict lateral moving or twisting of the brake pad in the socket to assure firm, permanent retention. Similarly, front ledge 74 and rear ledge 72 are formed adjacent the front and rear of arcuate protrusion 52 and space the protrusion inwardly a predetermined distance from the front and rear pad faces 78 and 76, respectively. These front and rear ledges receive the lower edges 80 and 82 of the brake housing, and these edges cooperate with the ledges, to inhibit forward and rearward rocking of the pad about the passage 62 during braking operation.

Positioned within the body of the pad 42 is a rigid metal plate 84, which may consist of a conventional washer having a central aperture 86 which is coaxial with and part of passage 62. The plate 84 provides additional support and rigidity to the protrusion 52, and when the pad is installed in the housing 26 and screw 38 and nut 40 tightly installed in the passage 62, the plate 84 bears against the shaft of the screw 38, providing additional support to the protrusion and inhibiting undesirable wear between the screw and the rubber material along passage 62. Equally important, the plate 84 serves as a wear indicator for the brake pad, providing a mechanism by which when the base 50 wears down, the edge of plate 84 becomes exposed as shown in FIG. 5, and the lower edge 88 begins to drag on the road surface 96 during braking. As the edge 88 drags, highly noticeable vibration is generated and immediately sensed by the skater, and the feel of the brake, as perceived by the skater, changes dramatically. The dragging of the plate also generates a distinctive sound which serves to immediately alert the skater that it is necessary to remove the worn brake pad and replace it with a new pad.

The metal plate 84, as shown in FIG. 3, may take the form of a more elongated body 90 extending downwardly and ending adjacent base 50, and such an alternative unit is shown by phantom extension line 90 which designates the outer periphery of an extended plate which is within the purview of the invention. When the skate is used for outdoor skating the extended plate 90 can provide a highly desirable wear indicator to alert the skater that pad replacement should be considered before substantial further wear occurs. The smaller, alternative plate structure represented by washer 92 is more suitable where the pad 26 will be used for indoor skating, and the destructive rubbing that might occur between a metal plate and a wooden or synthetic floor surface is to be avoided. In such a situation the washer 92 will be exposed as a wear indicator only when pad wear reaches a more advanced state. When such a state is needed, the washer alerts the skater that the lower edge 70 of the brake housing 26 is in jeopardy of being worn away unless the brake pad is replaced.

In operation, each roller skate 10 is provided with a frame 14 having a brake housing 26 at the rear thereof with a brake pad 42 attached thereto as described.

When the skater wishes to actuate the brake, he raises the front end 11 of one or both of his skates, causing the skate to pivot about the axis 20 of rear wheel 15. As this pivoting motion occurs, the skate moves from its initial coasting or riding position 98 and swings through an arc A to the braking position 100 (FIG. 7) where the base 50 contacts the road surface 96. Because the size of the arc A is approximately twelve degrees, the skater need raise the front end 11 of his skate only about twelve degrees to bring the generally flat, high friction base 50 of the brake pad into full facial engagement with the road surface. The longer rectangular flat base 50, with its increased surface area, rapidly slows and stops skate movement.

By reason of the smaller arc A achieved by the invention the skater does not have to bend his ankles or lean rearwardly to the extent required by prior art braking systems, and he is able to remain better balanced and to feel more in control during the stopping process. The reduction of the arc A to approximately twelve degrees makes the skate 10 safer, much easier to operate for new skaters, and significantly reduces the time required to learn how to operate the skate brake.

As the base 50 is urged against the riding surface 96, strong frictional forces are generated therebetween which tend to act on the brake base 50 in a rearward direction 102 (FIG. 4) to pull the pad loose from the socket and to rotate or twist the brake pad 42 about the passage 62. Such forces are countered by the strong engagement between pad 42 and socket 44. Arcuate protrusion 52 is securely received within the socket 44 and raised rib 64 within slot 48 to prevent any rotation of the pad when the screw 38 and nut 40 are securely in place. The tightening of screw 38 into the nut 40 forces the side walls 28 and 30 against the ends 54 and 56 of the arcuate protrusion, clamping the protrusion within the socket. The rigid plate 84 bears against the screw 38 as braking forces are applied to the base 50 of the brake pad. The plate absorbs wear which would otherwise occur between screw 38 and passage 62 and reinforces the brake pad, providing additional strength and rigidity to the protuberance 52 at the point of its contact with the screw.

Front and rear ledges 74 and 72 interact with edges 80 and 82 of downwardly extending front wall 33 and rear wall 32, respectively, the rear ledge 72 moving into contact with rear wall 32 during braking and the rear wall serving as a deterrent against counterclockwise rotation or twisting of the brake pad about the passage 62 ( FIG. 4) When the skater brakes during rearward skating, the front wall 33 of the housing similarly interacts with the front ledge 74 of the pad to prevent unwanted clockwise rotation or twisting of the pad about the passage 62.

At times the skater will be applying the brakes while turning or while engaging in sharp lateral skate twisting during stopping and these maneuvers generate forces which act laterally along the direction of passage 62 and are applied to the base 50. By tightly clamping the side walls 28 and 30 against the pad and the utilization of the lower edge 70 of the sidewalls to bear against and closely contact the lateral ledges 66 and 68, the brake housing 14 successfully resists any tendency of the brake pad to twist to the side during stopping and provides a stronger, safer and more reliable brake.

After sufficient braking use of brake pad 42, the base 50 will wear down until eventually as shown in FIG. 5 the lowermost edge 88 of plate 84 becomes exposed at its intersection with the worn base 50'. When the plate is exposed, the dragging interaction between the plate 84 and the road surface generates a distinct vibration which can be immediately felt and sensed by the skater and alerts him that the brake pad needs replacement. Simultaneously, the dragging interaction between the lower end 88 of the plate 84 against the road surface also generates a highly distinctive sound audible to the skater and alerts the skater to the need for brake pad replacement. Use of the plate 82 as a wear indicator thus provides a positive sign to skaters that skate maintenance is needed and helps assure that brake pad replacement occurs in a timely manner.

While the preferred embodiments of the present invention have been described, it should be understood that various changes, adaptations and modifications may be made therein without departing from the spirit of the invention and the scope of the appended claims.

What is claimed is:

1. A roller skate and brake usable by a skater for skating on a road surface, comprising:

a roller skate boot;

a roller skate frame carried by said boot, said frame having front and rear ends and including a brake pad housing at one end of said frame;

a plurality of wheels including a rear wheel, each said wheel rotatably mounted to said frame for rotation about an axis, with all said axes being parallel and at least two of said wheels being coasting wheels positioned to contact the road surface during coasting on the skate, said axes of said coasting wheels defining a first plane;

a brake pad comprising a body of material having a high coefficient of friction and said body carried by said brake housing, extending downwardly therefrom and including a base confronting the road surface for selective frictional engagement with the road surface;

said base having a substantially flat surfaced face adapted for full facial engagement with the road surface;

said skate frame being pivotable about said rear wheel axis between a first position, wherein said coasting wheels contact the road surface, and a second position, wherein said face of said base of said brake pad is in full facial engagement with the riding surface;

said housing further including a socket, said socket having first and second lateral side walls with each said side wall having an aperture, and the said apertures being substantially coaxial, with their common axis being substantially parallel to said wheel axes;

said brake pad being mateably mounted within said socket;

said brake pad body including a rigid metal plate within said pad, said plate being closely surrounded by said material and oriented substantially perpendicular to said wheel axes when said pad is mateably received in said socket, said body and plate having a hollow bore substantially coaxial with said apertures of said frame to define a continuous passage through said pad body, plate and side walls;

said brake further including fastening means passing through said continuous passage to securely retain said brake pad within said socket; and said rigid plate inhibiting wear on said pad which might otherwise result from rubbing of said body against said fastening means and in addition further defining a brake pad wear indicator to audibly and visibly indicate need for pad replacement when said material of said body wears away to expose said plate to direct frictional contact with the road surface.

2. The roller skate and brake of claim 1 wherein said plate is a washer.

3. The roller skate and brake of claim 2 wherein said brake pad has first and second side faces and said plate is positioned substantially medially between said side faces.

4. The roller skate and brake of claim 3 wherein said socket has an arcuate cross section, and said pad has an arcuate protrusion mateably received in said arcuate cross section socket.

5. The roller skate and brake of claim 4 wherein said arcuate protrusion has a substantially constant radius of curvature centered on said passage.

6. The roller skate and brake of claim 5 wherein said plate is a circular washer and is positioned concentric with said arcuate protrusion.

7. The roller skate and brake of claim 6 wherein said socket includes a transverse slot substantially parallel to said passage, and said pad includes a transverse tongue positioned to be mateably received within said slot to inhibit forward and rearward rotation of said protrusion about said passage during braking operation.

8. The roller skate and brake of claim 2 wherein said pad has said protrusion spaced inwardly a predetermined distance from said first and second side faces to define a pair of ledges with a said ledge on each side of said protrusion to permit said frame side walls to contact said ledges and to bear against said pad ledges to further stabilize said pad.

9. The roller skate and brake of claim 1 wherein said socket includes a transverse slot substantially parallel to said axes, and said pad includes a transverse tongue positioned to be mateably received within said slot to inhibit forward and rearward rocking of said protrusion about said passage during braking operation.

10. A roller skate and brake usable by a skater for skating on a road surface, comprising:

a roller skate boot;

a roller skate frame having a rear end and carried by said boot;

a plurality of wheels rotatably mounted to said frame for rotation about a plurality of substantially parallel axes;

said frame including a brake pad housing at said rear end of said frame and said frame including a socket, said socket having first and second lateral side walls with each said side wall having an aperture, the said apertures being substantially coaxial, with their common axis being substantially parallel to said wheel axes;

a brake pad comprised of a body of material having a high coefficient of friction mateably mounted within said socket and extending downwardly therefrom toward and confronting the road surface;

said brake pad body including a rigid metal plate within said pad, said plate being closely surrounded by said material and oriented substantially perpendicular to said wheel axes when said pad is mateably received in said socket, said body and plate having a hollow bore substantially coaxial with said apertures of said frame to define a continuous passage through said pad body, plate and side walls;

fastening means passing through said continuous passage to securely retain said brake pad within said socket; and said rigid plate inhibiting wear on said pad which might otherwise result from rubbing of said body against said fastening means and defining a brake pad wear indicator to audibly and visibly indicate need for pad replacement when said material of said body wears away to expose said plate to direct frictional contact with the road surface.

11. The roller skate and brake of claim 10 wherein said plate is a washer.

12. The roller skate and brake of claim 10 wherein said brake pad has first and second side faces and said plate is positioned substantially medially between said side faces.

13. The roller skate and brake of claim 10 wherein said socket has an arcuate cross section, and said pad has an arcuate protrusion mateably received in said arcuate cross section socket.

14. The roller skate and brake of claim 13 wherein said arcuate protrusion has a substantially constant radius of curvature centered on said passage.

15. The roller skate and brake of claim 14 wherein said plate is a circular washer and is positioned concentric with said arcuate protrusion.

16. The roller skate and brake of claim 15 wherein said socket includes a transverse slot substantially parallel to said passage, and said pad includes a transverse rib positioned to be mateably received within said slot to inhibit forward and rearward rotation of said protrusion about said passage during braking operation.

17. The roller skate and brake of claim 16 wherein said pad has said protrusion spaced inwardly a predetermined distance from said first and second lateral side faces to define a pair of lateral ledges with a said lateral ledge on each side of said protrusion to permit said frame side walls to contact and bear against said lateral ledges to further retain and stabilize said brake pad in said socket.

18. The roller skate and brake of claim 10 wherein said socket includes a transverse slot substantially parallel to said wheel axes, and said pad includes a transverse rib positioned to be mateably received within said slot to inhibit forward and rearward rocking of said protrusion about said passage during braking operations.

* * * * *